US006035155A

United States Patent [19]

Kaji et al.

[11] Patent Number: 6,035,155

[45] Date of Patent: Mar. 7, 2000

[54] FIXING DEVICE AND IMAGE FORMING APPARATUS HAVING SUCH DEVICE

[75] Inventors: Keigo Kaji, Toride; Kensaku Kusaka, Moriyamachi, both of Japan

[73] Assignee: Canon Kabushiki Kaisha, Tokyo, Japan

[21] Appl. No.: 08/719,081

[22] Filed: Sep. 24, 1996

[30] Foreign Application Priority Data

Sep. 28, 1995 [JP] Japan ..... 7-250883

[51] Int. Cl.[7] ..... G03G 15/20

[52] U.S. Cl. ..... 399/69; 399/33; 399/88

[58] Field of Search ..... 399/33, 37, 69, 399/70, 88, 328

[56] References Cited

U.S. PATENT DOCUMENTS

| | | | |
|---|---|---|---|
| 5,043,763 | 8/1991 | Koh et al. | 399/335 |
| 5,132,744 | 7/1992 | Maruta et al. | 399/329 |
| 5,241,155 | 8/1993 | Koh et al. | 399/338 X |
| 5,266,774 | 11/1993 | Kimura et al. | 399/335 X |
| 5,367,369 | 11/1994 | Nakai et al. | 399/69 |
| 5,376,773 | 12/1994 | Masuda et al. | 399/69 X |
| 5,401,936 | 3/1995 | Kusaka et al. | 399/335 X |
| 5,457,516 | 10/1995 | Kim | 399/37 |
| 5,528,346 | 6/1996 | Kim et al. | 399/33 |

FOREIGN PATENT DOCUMENTS

| | | |
|---|---|---|
| 390 168 | 1/1990 | European Pat. Off. . |
| 483 869 | 5/1992 | European Pat. Off. . |
| 523 638 | 1/1993 | European Pat. Off. . |
| 59-206854 | 11/1984 | Japan . |
| 60-191277 | 9/1985 | Japan . |
| 63-313182 | 12/1988 | Japan . |
| 2-157878 | 6/1990 | Japan . |
| 7-129024 | 5/1995 | Japan . |
| 7-160133 | 6/1995 | Japan . |
| 2249525 | 5/1992 | United Kingdom . |

OTHER PUBLICATIONS

Obara, Tsuneo; Reducing the Power Consumption of Copier Fuser Lamps, British Publication No. 224525A, Abstract only; May 13, 1992.

*Primary Examiner*—Fred L. Braun
*Attorney, Agent, or Firm*—Fitzpatrick, Cella, Harper & Scinto

[57] ABSTRACT

A fixing device and an image forming apparatus having such a device is constructed by an unfixed image forming unit to form an unfixed image onto a recording material in accordance with start of an image formation, a heater in which a heat generating material which generates a heat by an energization is provided on a substrate, the unfixed image formed by the unfixed image forming unit being heated and fixed onto the recording material by a heat from the heater, and a power supplying unit for supplying an electric power to the heater in a first mode with a first maximum power by the start of the image formation and, subsequently, for supplying an electric power to the heater in a second mode with a second maximum power. The first maximum power is smaller than the second maximum power. In both of the first and second modes, the powers are controlled so that the heater is set to a predetermined temperature. When a predetermined time elapses from the start of the energization by the start of the image formation or when a temperature sensor detects a predetermined temperature of the heater, the operating mode is changed from the first mode to the second mode.

36 Claims, 7 Drawing Sheets

FIXING DEVICE AND IMAGE FORMING APPARATUS HAVING SUCH DEVICE

BACKGROUND OF THE INVENTION

1. Field of the Invention

The invention relates to an image forming apparatus such as copying apparatus, printer, or the like and, more particularly, to a fixing device which is applied to such an image forming apparatus.

2. Related Background Art

Hitherto, in an image forming apparatus such as copying apparatus, laser beam printer, or the like using an electrophotographic method or an electrostatic recording method, in case of forming an image, first, an electrostatic latent image corresponding to an original image or an image signal which was inputted is formed on the surface of a photosensitive material or a dielectric material as an image holding member. The electrostatic latent image is developed as a toner image by developing means by using a toner having predetermined charges. The toner image developed on the image holding member is electrostatically transferred onto a recording material by transfer means. The toner image on the recording material is fixed onto the recording material by fixing means.

Hitherto, as a fixing method in such a kind of image forming apparatus, a heat roller method of conveying a recording material holding a toner image while sandwiching it by a heating roller and a pressurizing roller has been widely used. In such a heat roller method, since a heat capacity of the heating roller is large, there is a problem such that it takes a long time (what is called a warm-up time) which is required to heat the heating roller up to a predetermined temperature.

Therefore, a film heating fixing method whereby a warm-up time is reduced by using a thermal head of a low heat capacity and a thin film which moves in slide contact with the thermal head has been proposed (refer to Japanese Patent Laid-Open Application Nos. 63-313182, 2-157878, or the like).

As such a thermal head of a low heat capacity, a ceramic heater constructed in a manner such that a heat generating layer of a resistor member is provided on a substrate made of ceramic or the like and a protecting layer is further formed on the heat generating layer is generally used. Since the ceramic heater has a low heat capacity, it is possible to rapidly raise a temperature in a short time. On the other hand, when the temperature is raised, if an electric power is applied to the ceramic heater, there is a case where the heater is deformed by a stress due to a temperature difference in the heater. When rapidly raising the temperature with a low heat capacity, it is desired that a thickness of the heater is reduced as thin as possible and a large electric power is applied to the ceramic heater. However, in this case, there is a problem such that a possibility that the heater is damaged by a stress due to the foregoing temperature difference in the heater rises.

SUMMARY OF THE INVENTION

It is an object of the invention to provide a fixing device and an image forming apparatus which prevent that a heater is damaged by energization when the heater is made operative.

Another object of the invention is to provide an image forming apparatus having electric power supplying means for supplying an electric power to a heater in a first mode with a first maximum electric power by the start of an image formation and, after that, supplying an electric power to the heater in a second mode with a second maximum electric power, wherein the first maximum electric power is smaller than the second electric power.

Still another object of the invention is to provide a fixing device having electric power supplying means for supplying an electric power to a heater in a first mode with a first maximum electric power by the start of energization and, after that, supplying an electric power to the heater in a second mode with a second maximum electric power, wherein the first maximum electric power is smaller than the second maximum electric power.

The above and other objects and features of the present invention will become apparent from the following detailed description and the appended claims with reference to the accompanying drawings.

DETAILED DESCRIPTION OF THE PREFERRED EMBODIMENTS

Figure 1:
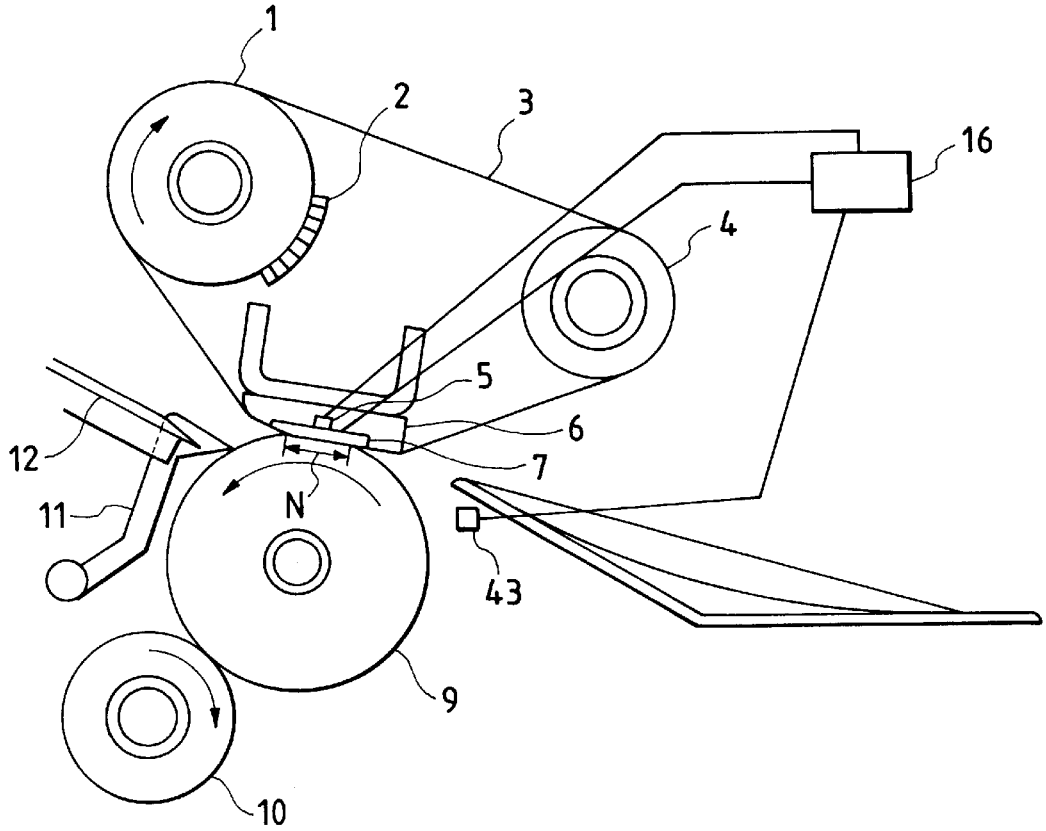
FIG. 1 is a side elevational view of a fixing device according to an embodiment of the invention.

Embodiments of the invention will now be described on the basis of the drawings.

First Embodiment

The first embodiment will be first explained with reference to FIGS. 1 to 5. FIG. 3 is a diagram showing a schematic construction of an example of an image forming apparatus using a fixing device 60 of the embodiment. As shown in FIG. 3, the image forming apparatus of the embodiment is an electrophotographic copying apparatus of a type of a fixed original supporting plate, an optical system moving type, a rotary drum type, and a transfer type.

In the apparatus, as shown in FIG. 3, an original 19 is put on a fixed original supporting glass plate 20 as necessary and necessary copying conditions are set. After that, by pushing a copy start key 40 as image formation start signal input means, a signal based on the start of the image formation is generated and a photosensitive drum 39 is rotated clockwise shown by an arrow at a predetermined peripheral velocity. A light source 21 (reference numeral 22 denotes a reflecting cap) and a first mirror 23 are moved along the lower surface of the original supporting glass plate 20 from a home position on the left side of the glass to the right side of the glass at a predetermined speed V. A second mirror 24 and a third mirror 25 are moved in the same direction as the above direction at a speed of V/2. Thus, the downward image surface of the original 19 put on the original supporting glass plate 20 is illuminated and scanned from the left side to the right side. A reflected light of the illuminating and scanning light from the original surface passes through an image forming lens 29, is reflected by fixed fourth to sixth mirrors 26 to 28, and is exposed (slit exposure) so as to form an image onto the surface of the rotary photosensitive drum 39.

The surface of the rotary photosensitive drum 39 has uniformly been charged to a positive or negative predetermined electric potential by a primary charging unit 30 before the exposure. By performing the above exposure to the charged surface, electrostatic latent images of a pattern corresponding to the original image are sequentially formed on the surface of the drum 39. The electrostatic latent image formed on the surface of the photosensitive drum 39 is visualized as a toner image by a developing roller 32 of a developing device 31.

On the other hand, a recording material P is fed by a paper feed roller 51 and is introduced to a transfer portion between the drum 39 and a transfer charging unit 34 through a guide 33 at a predetermined timing and is come into contact with the drum 39 by receiving a transfer corona. Thus, the visual toner images on the surface of the drum 39 are sequentially transferred onto the surface of the recording material.

The recording material P which passed through the image transfer portion is gradually separated from the surface of the drum 39 while being subjected to a discharging process to remove the charges on the rear surface by a charge removal needle 35. The recording material P is conveyed to the fixing device 60 by a conveying unit 38 and an inlet guide 8. The toner image is fixed as will be described hereinafter. The recording material is ejected to the outside of the apparatus as an image formed object.

A fouling such as a remaining toner or the like on the surface of the drum 39 after the transfer is cleaned and eliminated by a cleaning blade 37 of a cleaning unit 36 and the clean surface is repetitively used for the subsequent image formation.

The moving optical members 21 to 25 moved on the going path as mentioned above are set so that when they reach a predetermined final point of the going path, they are moved along the returning path. Therefore, they are returned to the original home position and wait until the start of the next copying cycle (hereinbelow, this step is called a back step of the optical system).

When a plurality of copies (for example, 100 sheets) is designated before a start key for copying is pushed, after completion of the back step of the optical system, the above processing steps are repeated at a predetermined interval by a microcomputer (hereinbelow, referred to an MPU).

The fixing device 60 which is installed to the apparatus will now be described in detail with reference to FIG. 1.

FIG. 1 is a constructional diagram of the fixing device of the image forming apparatus according to the invention.

In FIG. 1, reference numeral 3 denotes an endless belt-shaped fixing film. The fixing film 3 is stretched among a driving roller 1 on the left side, a driven roller 4 on the right side, and a linear heater 7 of a low heat capacity fixedly arranged under a portion between the rollers 1 and 4.

The driven roller 4 is also used as a tension roller for applying a tension in the direction of stretching the fixing film 3 outward. In association with a clockwise rotation of the driving roller 1 in which a coefficient of friction is raised by coating a silicone rubber or the like onto the surface, the fixing film is rotated clockwise at a predetermined peripheral velocity without a wrinkle, a zigzag movement, and a velocity delay.

Reference numeral 9 denotes a pressurizing roller serving as pressurizing means and having a rubber elastic layer such as a silicone rubber or the like of a good mold releasing performance. The roller 9 allows a film portion on the lower side of the endless belt-shaped fixing film 3 to be sandwiched between the roller 9 and heater 7, thereby allowing the film portion to face and be come into pressure contact with the lower surface of the heater 7 by urging means such as a spring or the like with a contacting force of, for example, 5 to 10 kg/cm. The pressurizing roller 9 rotates counterclockwise in the forward direction in the conveying direction of the recording material P.

Reference numeral 10 denotes a cleaning roller which is arranged so as to be driven and rotated in association of rotation of the pressurizing roller 9. The cleaning roller 10 is made of metal.

Since the endless fixing film 3 to be rotated is repetitively used to heat and fix the toner image, a thin film which is excellent in heat resistance, mold releasing performance, and durability and in which a thickness is generally equal to or less than 100 $\mu$m, preferably, 40 $\mu$m or less is used as a film 3. As an example, there is used an endless belt whose total thickness is equal to 30 $\mu$m obtained by a method whereby a resin of a low surface energy such as PTFE (tetrafluoroethylene resin), PFA (tetrafluoroethylene perfluoro alkylvinylether copolymer resin), or the like or a separating coating layer obtained by adding a conductive material such as carbon black or the like into any one of the above resins is coated by a thickness of 10 $\mu$m onto the outer circumferential surface of a thin endless belt having a thickness of 20 $\mu$m made of a high heat resisting resin such as polyimide, polyetherimide, polyethersulfone, polyether, etherketone, or the like or made of metal such as nickel, SUS, or the like.

Figure 4:
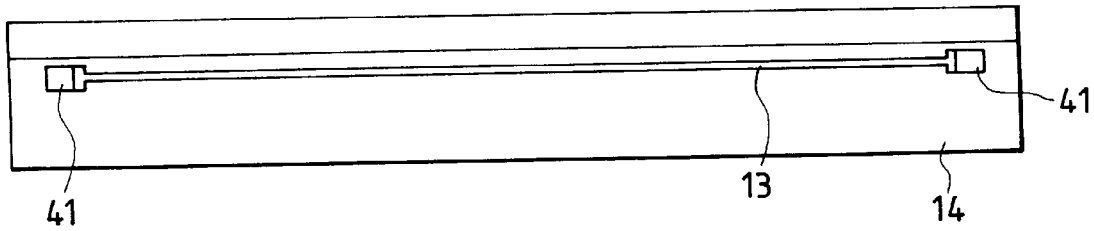
FIG. 4 is a plan view of the heater.

As shown in FIG. 4, the heater 7 of a low heat capacity is constructed as follows. A heat generating layer 13 is formed by coating a resistive material such as silver palladium, ruthenium oxide, or the like having a thickness of 10 $\mu$m and a width of 1.0 mm onto an alumina substrate 14 having a thickness of 1.0 mm, a width of 10 mm, and a length in the longitudinal direction of 340 mm and, further, a protecting layer 15 having a thickness of 10 $\mu$m made of glass or the like is formed onto the layer 13 in consideration of the sliding with the film 3. The heater 7 is attached to and is held by a heater supporting member 6, thereby fixedly supporting.

Figure 2A:
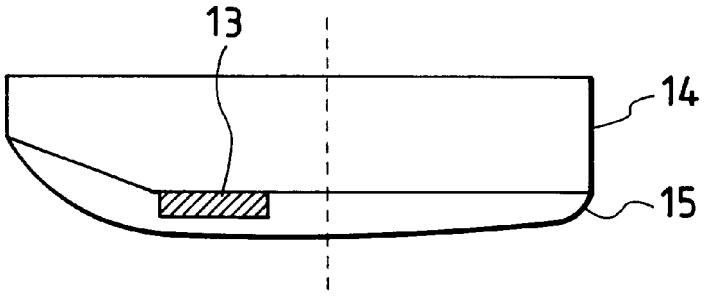
FIGS. 2A to 2D are side elevational views of a heater.
Figure 3:
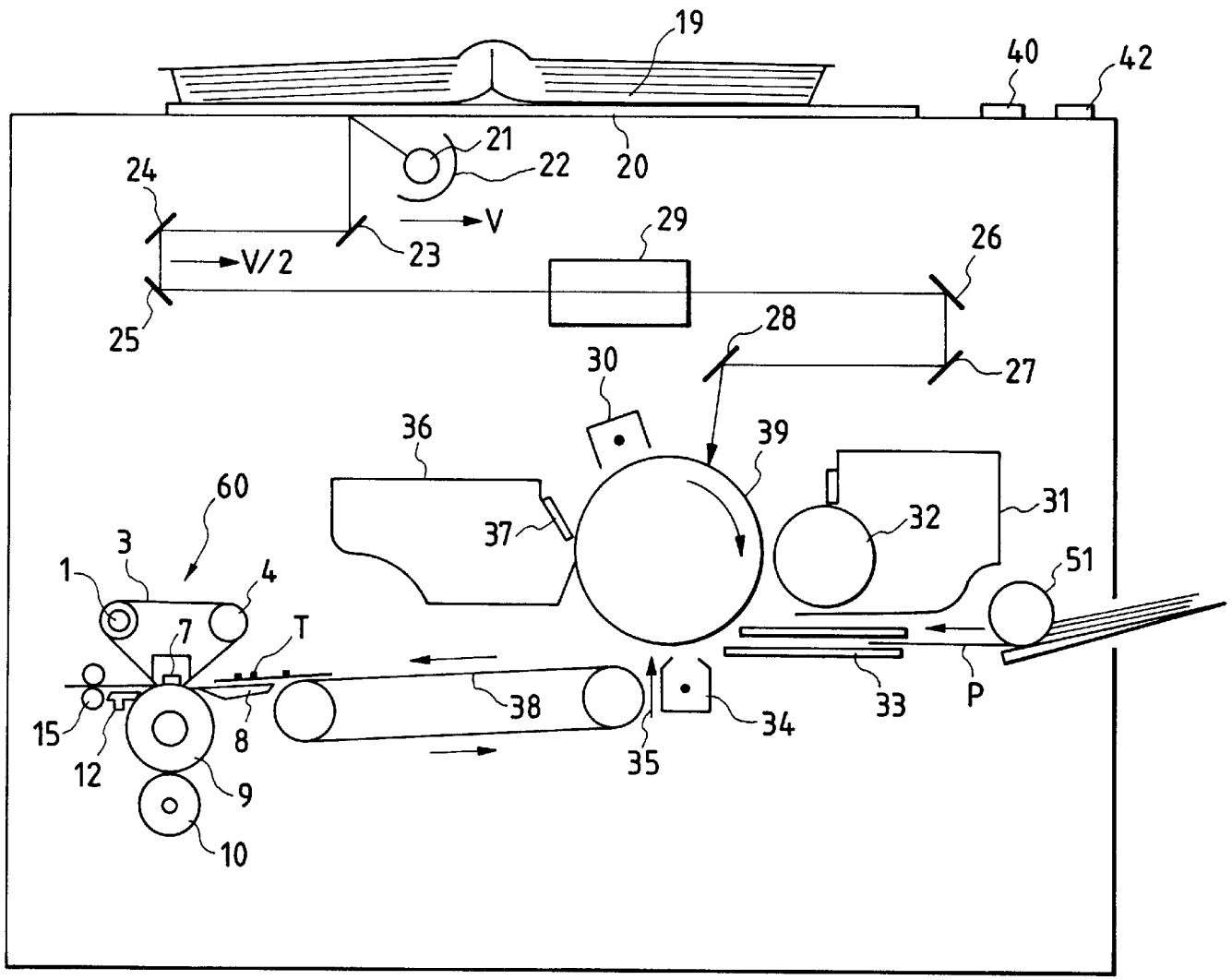
FIG. 3 is a constructional diagram of an image forming apparatus according to an embodiment of the invention.

As shown in FIG. 2A, in the heater 7, the substrate 14 on the paper ejecting side is chamfered and the heat generating layer 13 is deviated to the paper ejecting side with respect to the center in the width direction of the substrate 14.

The heater supporting member 6 has a heat insulating performance, a high heat resistance, and a rigidity in order to insulate the heat and support the heater 7 for the fixing device and the image forming apparatus and is constructed by a high heat resisting resin such as PPS (polyphenylene sulfite), PEEK (polyether etherketon), liquid crystal polymer, or the like, a composite material of the above resin and ceramics, metal, or the like.

The heat generating layer 13 of the heater is energized from both edges in the longitudinal direction. As shown in FIG. 4, electrodes 41 to energize are provided at both edges of the heat generating layer 13. The energization is performed by 100 ACV and is controlled in accordance with a detection temperature of a thermistor 5 as temperature detecting means such as an NTC (negative temperature-resistance coefficient) thermistor or the like which is adhered by a heat conductive silicone rubber adhesive agent or the like onto the back surface of the substrate 14, or is come into pressure contact therewith, or is formed integratedly therewith.

The energizing control method is based on a phase control and an electric power supply to the heater can be controlled step by step.

The operation of the fixing device of the apparatus in the embodiment will now be explained hereinbelow. When a power source of the main apparatus is turned on by a main switch 42, the driving roller 1 begins to rotate. In association with the rotation, the fixing film 3, tension roller 4, pressurizing roller 9, and cleaning roller 10 start rotating. The energization from a heater driving circuit 16 as electric power control means to the heater 7 is started with a slight delay time after the start of the rotation. In the embodiment, an electric power of 500 W is applied for five seconds while adjusting a temperature to 200° C. The temperature adjustment to 200° C. is performed in a manner such that when the detection temperature of the thermistor 5 is lower than 195° C., a predetermined maximum electric power (500 W during the preliminary energizing operation) is applied, when the detection temperature is equal to or higher than 195° C. and is lower than 200° C., 500 W is applied, when the detection temperature is equal to or higher than 200° C. and is lower than 205° C., 200 W is applied, and when the detection temperature is equal to or higher than 205° C., the energization is stopped. After the energizing time elapsed and the energization was finished, the rotation of the driving roller 1 is stopped with a slight delay time. The operations so far indicate the preliminary energizing operation.

At the time of the image formation, when the image formation is started by depressing the copy start key 40 provided for the main body by the operation, the driving roller 1 starts rotating and the fixing film 3, tension roller 4, pressurizing roller 9, and cleaning roller 10 also begin to rotate in association with the rotation of the roller 1. The energization from the heater driving circuit 16 to the heater 7 is started by a slight delay time after the start of the rotation. An image formation start signal which is generated by the copy start key is a signal serving as a reference to start the energization. In this instance, a first mode to apply a first maximum applied electric power W1 is executed for a predetermined time after the start of the energization and a second mode to apply a second maximum applied electric power W2 which is larger than W1 is executed after the elapse of the predetermined time. In the embodiment, while adjusting the temperature to 200° C., 600 W in maximum is applied for three seconds and, subsequently, 800 W in maximum is applied.

Figure 5:
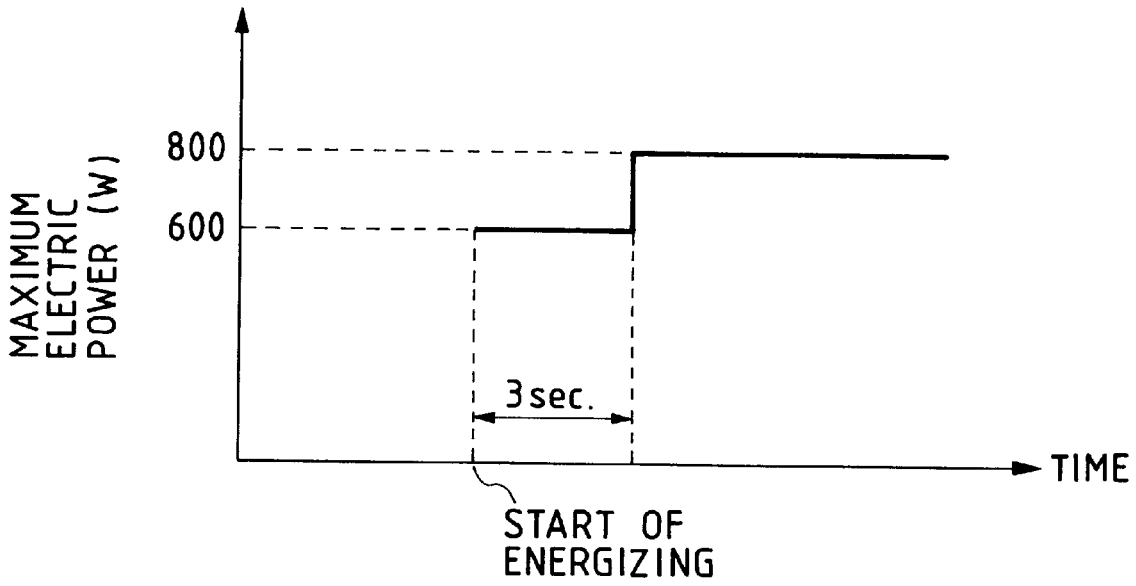
FIG. 5 is an explanatory diagram of an electric power control of the first embodiment.

That is, in the first and second modes, the temperature adjustment is performed by selecting the electric powers of various magnitudes so that the temperature of the heater is set to 200° C. as a predetermined fixing temperature. In this instance, the electric power is controlled in a manner such that the electric power of 600 W in maximum is supplied in the first mode and 800 W in maximum is supplied in the second mode. As mentioned above, the maximum electric power in the first mode is smaller than that in the second mode. FIG. 5 shows such a situation.

When the recording material P enters a nip portion N, the thermistor detection temperature has reached a predetermined fixing temperature (200° C. in the embodiment). The recording material P is overlapped with the fixing film 3 to enter the nip portion N while bearing an unfixed toner image T on the upper surface thereof. When passing through the nip portion N, the recording material P and unfixed toner image T receive the heat generated by the heat generating layer 13 via the fixing film 3 while receiving a pressuring force by the heater 7 and pressurizing roller 9. The toner image is melted at a high temperature and becomes an image which was softened and adhered to the recording material P. After a rear edge of the recording material P passed through the nip portion N, the energization to the heater 7 is stopped and, after that, the driving roller 1 is stopped after a slight delay time.

The fixing device has a function (automatic shut-off function) whereby the power source of the main body is automatically turned off when five minutes elapses after the end of the energization.

By constructing the fixing device as mentioned above, since a large electric power is not supplied to the heater at the initial stage of the activation of the heater, even if the device is used in an environment of a low temperature, no damage occurs in the fixing heater, particularly, in the substrate and a good fixing performance is obtained.

Figure 2B:
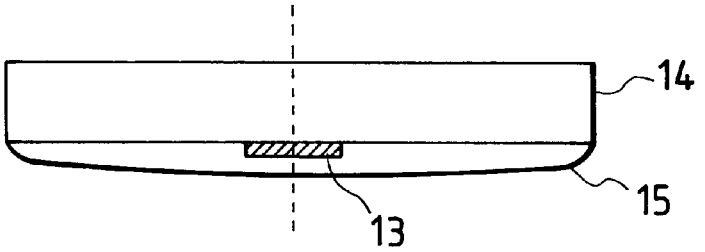
Figure 2C:
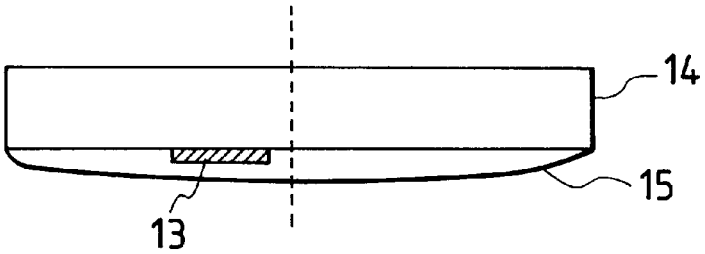
Figure 2D:
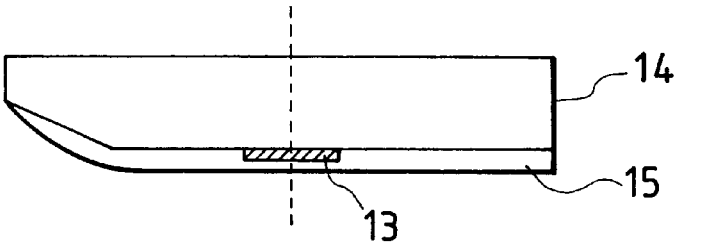

As for the heater 7, as shown in FIG. 2B or 2C, the heat generating layer can be arranged symmetrically or asymmetrically with respect to the center line in the width direction of the substrate like a rectangle having a sectional surface which is symmetric with respect to the center line in the width direction of the substrate. Or, as shown in FIG. 2D, the heat generating layer can be also arranged symmetrically with respect to the center line in the width direction of the substrate having a sectional surface which is asymmetric with respect to the center line in the width direction of the substrate in a manner similar to the heater substrate 14.

Comparison Example 1

In the embodiment 1, when the maximum applied electric power at the time of the preliminary energization is set to 800 W in a manner similar to the case of the image formation or 800 W is applied from the beginning without applying 600 W for three seconds at the time of the image formation, there is an example in which the heater 7 is damaged during the energization of 800 W in the environment of a low temperature. This is because by applying a large electric power to the heater 7 in a state of a low temperature, a temperature difference occurring between a portion near the heat generating layer 13 and the back surface of the heater 7 increases and the heater 7 cannot endure a stress due to the temperature difference.

Second Embodiment

The second embodiment is fundamentally the same as the first embodiment and different points will be now explained hereinbelow.

Figure 6:
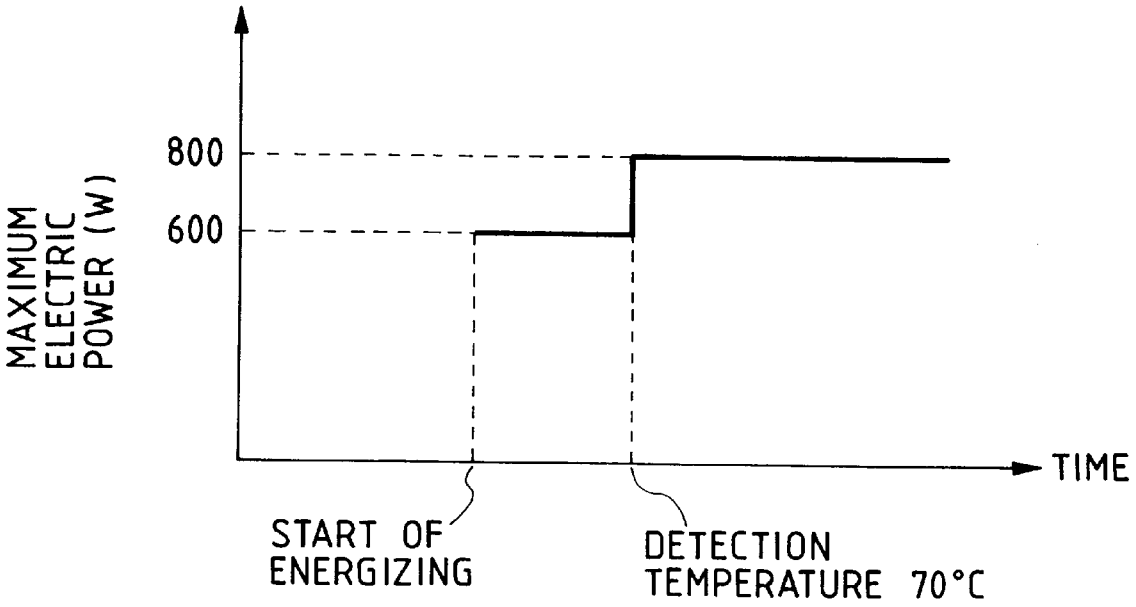
FIG. 6 is an explanatory diagram of an electric power control of the second embodiment.

In the first embodiment, at the time of the image formation, the maximum applied electric power has been set to a low value for a predetermined time after the start of the energization. However, according to the embodiment, the maximum applied electric power is set to a low value until the thermistor 5 detects a predetermined temperature after the start of the energization. In the embodiment, an electric power of 600 W is applied until the detection temperature of the thermistor 5 reaches 70° C. (first mode) and, after that, 800 W is applied (second mode). FIG. 6 shows the above situation.

By constructing the fixing device as mentioned above, it is possible to detect that the temperature of the heater has certainly risen by a low electric power, no damage occurs in the fixing heater even in the use under an environment of a low temperature, and a good fixing performance is obtained.

Third Embodiment

Figure 7:
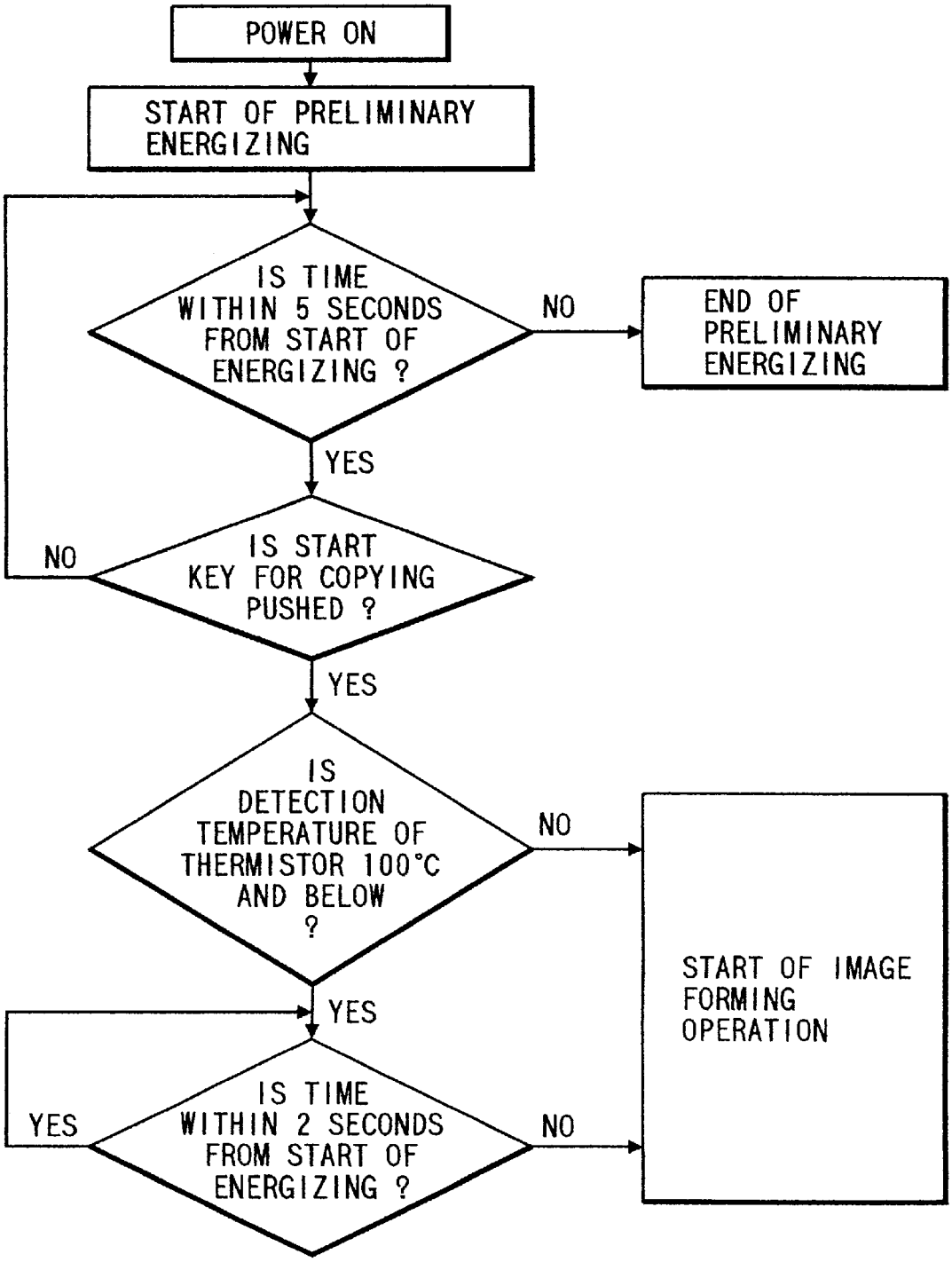
FIG. 7 is a flowchart showing an electric power control of the third embodiment.

According to the third embodiment, in addition to the first embodiment, when the copy start key is depressed during the preliminary energization, if the detection temperature of the thermistor 5 at that time is lower than a predetermined temperature, a predetermined preliminary energization is executed for a time which is shorter than the preliminary energizing time in the case where the copy start key is not depressed during the preliminary energization. After that, the operating mode advances to the image forming operation. That is, according to the embodiment, when the copy start key is depressed before the preliminary energization is performed for two seconds by applying 500 W, so long as the detection temperature of the thermistor 5 is equal to or lower than 100° C., the preliminary energization is performed for two seconds and, after that, the operating mode advances to the image forming operation. When the detection temperature of the thermistor 5 is equal to or higher than 100° C. or the copy start key is depressed after the elapse of two seconds or more after the start of the preliminary energization, even during the preliminary energization (five seconds in the embodiment), the operating mode advances to the image forming operation at that time. FIG. 7 is a flowchart showing such a situation.

By constructing the fixing device as mentioned above, in the use under an environment of a low temperature, no damage occurs in the fixing heater and a good fixing performance is obtained.

Fourth Embodiment

The fourth embodiment is fundamentally similar to the first embodiment and different points will now be described.

Figure 8:
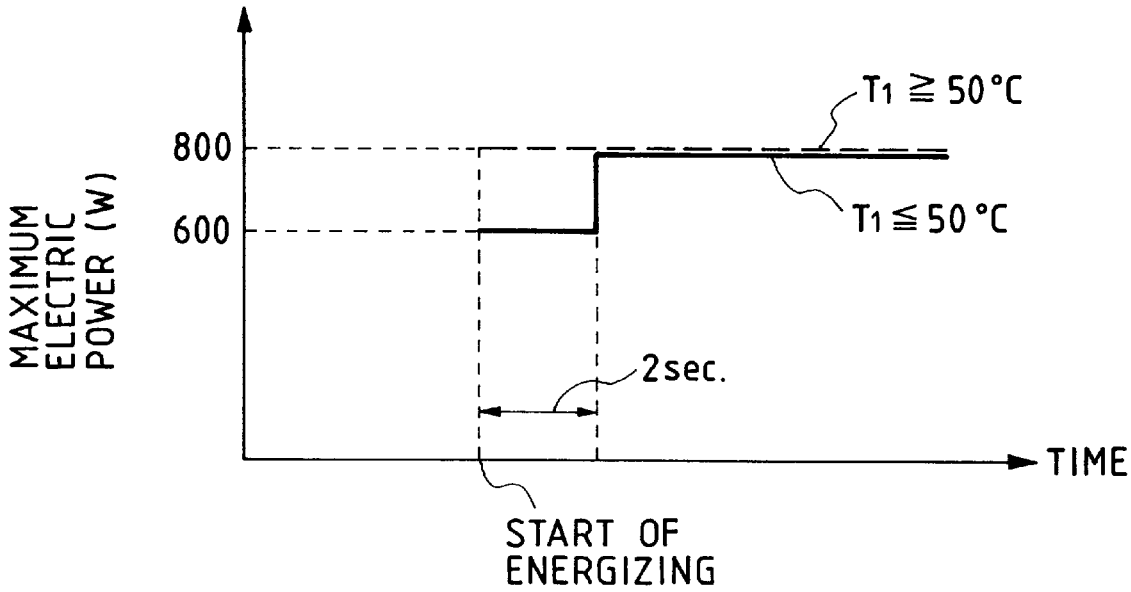
FIG. 8 is an explanatory diagram of an electric power control of the forth embodiment.
Figure 9:
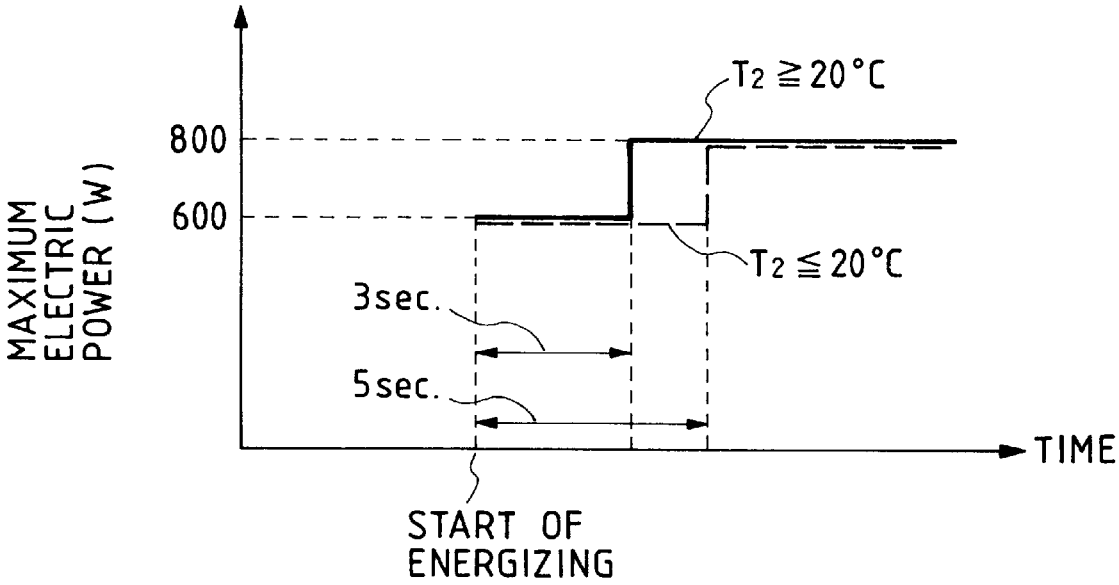
FIG. 9 is an explanatory diagram of an electric power control of the fifth embodiment.
Figure 10:
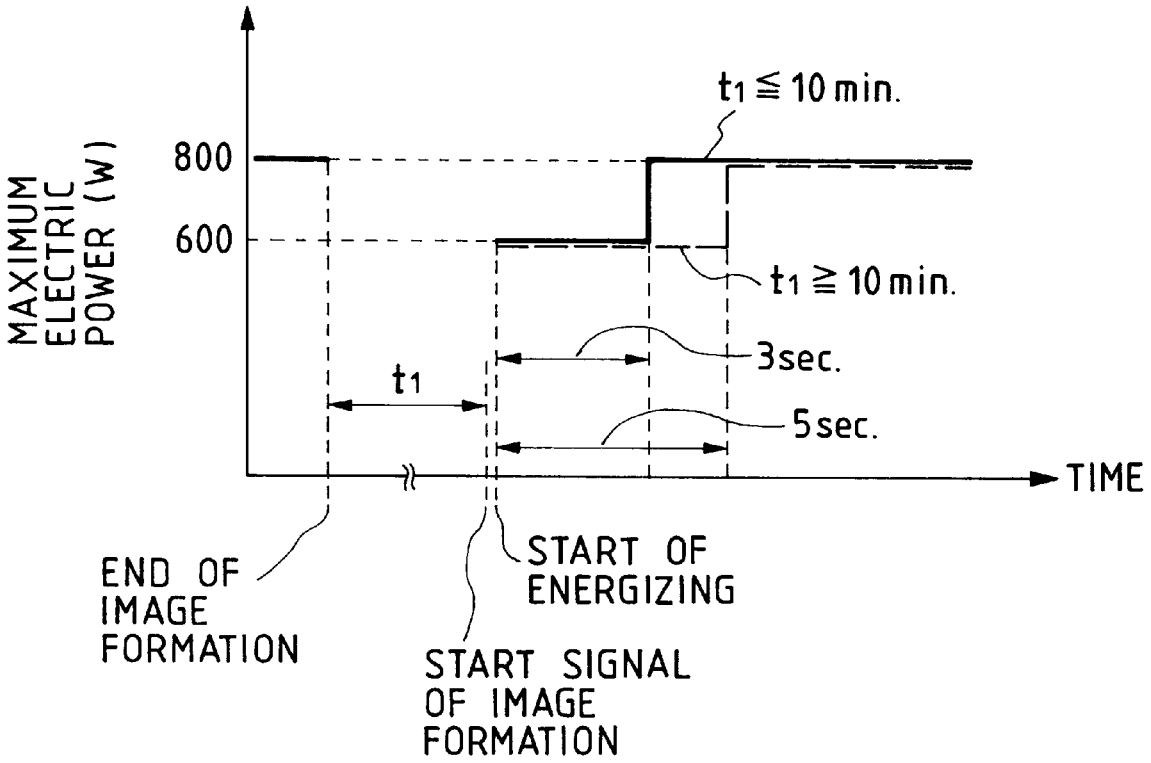
FIG. 10 is an explanatory diagram of an electric power control of the sixth embodiment.

Although the maximum applied power has been set to a small value for a predetermined time from the start of the energization at the time of the image formation in the first embodiment, the maximum applied power is changed in accordance with a detection temperature (T1) of the thermistor 5 when the copy start key 40 is depressed. In the fourth embodiment, when the detection temperature of the thermistor 5 is equal to or lower than 50° C., 600 W is applied (first mode) for two seconds and, after that, 800 W is applied (second mode). When the detection temperature of the thermistor 5 is equal to or higher than 50° C., the first mode is not performed but 800 W is applied (second mode). FIG. 8 shows such a situation.

By constructing the fixing device as mentioned above, even if the temperature of the heater decreases in the low temperature environment or the like, no damage occurs in the fixing heater and a good fixing performance is obtained. When the temperature of the heater is high, since the low power control is not performed, a rising timing of the heater can be made fast.

In place of the detection temperature of the thermistor 5 when the copy start key is depressed, the maximum applied power can be also changed in accordance with the time from the end of the previous image formation (end of energization) to the start of the next energization.

Fifth Embodiment

In addition to the construction of the first embodiment, the fifth embodiment is constructed in a manner such that an environment temperature sensor 43 to measure a temperature near the fixing device is provided and, when a detection temperature (T2) of the environment temperature sensor 43 at a time point when the copy start key 40 is depressed is lower than a predetermined temperature, the predetermined time during which the maximum applied power was reduced from the start of the energization at the time of the image formation is extended. In the fifth embodiment, when the detection temperature of the environment temperature sensor is equal to or lower than 20° C., the time for applying 600 W for two seconds (first mode) is extended and 600 W is applied for total five seconds and, after that, 800 W is applied (second mode). In this instance, the image forming operation other than the operation of the fixing device is started after the elapse of two seconds from the depression of the copy start key. When the detection temperature (T2) is equal to or less than 20° C., the first mode is performed for ordinary three seconds.

By constructing the fixing device as mentioned above, even in the use under the low temperature environment, no damage occurs in the fixing heater and a good fixing performance is obtained.

When the detection temperature of the environment temperature sensor is low, not only the applying time of the low electric power is extended but also the electric power can be further reduced.

Sixth Embodiment

In addition to the first embodiment, the sixth embodiment is constructed in a manner such that a time duration from the time point of the end of the preliminarily energizing operation or the copying operation is measured and the predetermined time during which the maximum applied power was reduced from the start of the energization at the time of the image formation is extended in accordance with a time (t1) when the copy start key is depressed. In the sixth embodiment, when ten minutes or more elapse after the end of the preliminary energizing operation or the copying operation, the time for applying 600 W for two seconds (first mode) is extended and 600 W is applied for total five seconds and, after that, 800 W is applied (second mode). In this instance, the image forming operation other than the operation of the fixing device is started after the elapse of two seconds from the depression of the copy start key.

When the measured time (t1) is shorter than 10 minutes, the first mode is performed for ordinary three seconds.

By constructing the fixing device as mentioned above, even in the use under a low temperature environment, no damage occurs in the fixing heater and a good fixing performance is obtained.

According to the invention as described above, in the fixing device, when the temperature of the heater in which the heat generating layer is provided on the substrate rises, the maximum value of the electric power which is applied to the heater at the initial rising time is set to be smaller than the maximum applied power in the subsequent rising time and during the image formation. Therefore, the heater is not damaged and the fixing device having a good fixing performance can be provided.

Although the present invention has been described above, the invention is not limited to the foregoing embodiments but many modifications and variations are possible within the spirit and scope of the appended claims of the invention.

What is claimed is:

1. An image forming apparatus comprising:

unfixed image forming means for forming an unfixed image onto a recording material in accordance with a start of an image formation;

a heater in which a heat generating material which generates heat by an energization is provided on a substrate;

the unfixed image formed by said unfixed image forming means being heated and fixed onto the recording material by heat from said heater; and power supplying means for supplying an electric power to said heater in a first mode with a first maximum power in accordance with the start of the image formation and, subsequently, for supplying an electric power to said heater in a second mode with a second maximum power, wherein said first maximum power is smaller than said second maximum power, when a predetermined time elapses from the start of the energization in accordance with the start of the image formation, an operating mode is changed from said first mode to said second mode.

2. An apparatus according to claim 1, wherein in both of said first and second modes, the electric powers are controlled so that said heater is set to a predetermined fixing temperature.

3. An apparatus according to claim 1, further having a main switch to turn on or off a power source of an apparatus main body, and wherein a preliminary energization is performed to said heater in association with the turn-on of said main switch.

4. An apparatus according to claim 3, wherein a maximum power which is supplied to said heater at the time of said preliminary energization is smaller than said first maximum power.

5. An apparatus according to claim 3, wherein when a signal based on the start of the image formation is inputted during said preliminary energization, said preliminary energization is executed for a predetermined time and, after that, the image formation is started.

6. An apparatus according to claim 5, wherein said predetermined time is shorter than the time required for the preliminary energization when the signal based on the start of the image formation is not inputted.

7. An apparatus according to claim 3, further having temperature detecting means for detecting a temperature of said heater, and wherein when a signal based on the start of the image formation is inputted during said preliminary energization, if the detection temperature at the time of the input of said signal by said temperature detecting means is lower than a predetermined temperature, the preliminary energization is performed for a predetermined time and, after that, the image formation is started, and when said detection temperature is higher than said predetermined temperature, the image formation is started without further executing the preliminary energization.

8. An apparatus according to claim 7, wherein said predetermined time is shorter than the time required for the preliminary energization when the signal based on the start of the image formation is not inputted.

9. An apparatus according to claim 1, wherein said substrate is made of alumina.

10. An apparatus according to claim 1, wherein said heat generating material is made of a resistive material coated on said substrate.

11. An apparatus according to claim 1, further comprising a film which is moved in slide contact with said heater and a roller to form a nip together with said heater through said film, wherein the recording material bearing the unfixed image is sandwiched and conveyed by said nip, and the unfixed image is heated and fixed onto the recording material by heat from said heater through said film.

12. An apparatus according to claim 1, wherein said substrate is made of ceramic.

13. An image forming apparatus comprising:

unfixed image forming means for forming an unfixed image onto a recording material in accordance with start of an image formation;

a heater in which a heat generating material which generates a heat by an energization is provided on a substrate;

the unfixed image formed by said unfixed image forming means being heated and fixed onto the recording material by a heat from said heater; and power supplying means for supplying an electric power to said heater in a first mode with a first maximum power in accordance with the start of the image formation and, subsequently, for supplying an electric power to said heater in a second mode with a second maximum power, wherein said first maximum power is smaller than said second maximum power, and temperature detecting means for detecting a temperature of said heater, wherein when said temperature detecting means detects a predetermined temperature, an operating mode is changed from said first mode to said second mode.

14. An image forming apparatus according to claim 13, wherein said substrate is made of ceramic.

15. An image forming apparatus according to claim 13, further comprising a film which is moved in slide contact with said heater and a roller to form a nip together with said heater through said film, wherein the recording material bearing the unfixed image is sandwiched and conveyed by said nip, and the unfixed image is heated and fixed onto the recording material by heat from said heater through said film.

16. An image forming apparatus comprising:

unfixed image forming means for forming an unfixed image onto a recording material in accordance with start of an image formation;

a heater in which a heat generating material which generates a heat by an energization is provided on a substrate;

the unfixed image formed by said unfixed image forming means being heated and fixed onto the recording material by a heat from said heater; and power supplying means for supplying an electric power to said heater in a first mode with a first maximum power in accordance with the start of the image formation and, subsequently, for supplying an electric power to said heater in a second mode with a second maximum power, wherein said first maximum power is smaller than said second maximum power, and temperature detecting means for detecting a temperature at a time point of the start of the image formation, wherein when the detection temperature by said temperature detecting means is lower than a predetermined temperature, a power control to change an operating mode from said first mode to said second mode is executed.

17. An apparatus according to claim 16, wherein said temperature detecting means detects a temperature of said heater.

18. An image forming apparatus according to claim 16, wherein said substrate is made of ceramic.

19. An image forming apparatus according to claim 16, further comprising a film which is moved in slide contact with said heater and a roller to form a nip together with said heater through said film, wherein the recording material bearing the unfixed image is sandwiched and conveyed by said nip, and the unfixed image is heated and fixed onto the recording material by heat from said heater through said film.

20. An image forming apparatus comprising:

unfixed image forming means for forming an unfixed image onto a recording material in accordance with start of an image formation;

a heater in which a heat generating material which generates a heat by an energization is provided on a substrate;

the unfixed image formed by said unfixed image forming means being heated and fixed onto the recording material by a heat from said heater; and power supplying means for supplying an electric power to said heater in a first mode with a first maximum power in accordance with the start of the image formation and, subsequently, for supplying an electric power to said heater in a second mode with a second maximum power, wherein said first maximum power is smaller than said second maximum power, and temperature detecting means for detecting a temperature at the time point of the start of the image formation, wherein an operating time for said first mode when the detection temperature by said temperature detecting means is lower than a predetermined temperature is longer than an operating time for said first mode when said detection temperature is higher than said predetermined temperature.

21. An apparatus according to claim 20, wherein said temperature detecting means detects an environment temperature.

22. An image forming apparatus according to claim 20, wherein said substrate is made of ceramic.

23. An image forming apparatus according to claim 20, further comprising a film which is moved in slide contact with said heater and a roller to form a nip together with said heater through said film, wherein the recording material bearing the unfixed image is sandwiched and conveyed by said nip, and the unfixed image is heated and fixed onto the recording material by heat from said heater through said film.

24. An image forming apparatus comprising:

unfixed image forming means for forming an unfixed image onto a recording material in accordance with start of an image formation;

a heater in which a heat generating material which generates a heat by an energization is provided on a substrate;

the unfixed image formed by said unfixed image forming means being heated and fixed onto the recording material by a heat from said heater; and power supplying means for supplying an electric power to said heater in a first mode with a first maximum power in accordance with the start of the image formation and, subsequently, for supplying an electric power to said heater in a second mode with a second maximum power, wherein said first maximum power is smaller than said second maximum power, and wherein an operating time for said first mode when an interval from end of previous image formation to the start of the present image formation is longer than a predetermined time is longer than an operating time for said first mode when said interval is shorter than said predetermined time.

25. An image forming apparatus according to claim 24, wherein said substrate is made of ceramic.

26. An image forming apparatus according to claim 24, further comprising a film which is moved in slide contact with said heater and a roller to form a nip together with said heater through said film, wherein the recording material bearing the unfixed image is sandwiched and conveyed by said nip, and the unfixed image is heated and fixed onto the recording material by heat from said heater through said film.

27. A fixing device comprising:

a heater in which a heat generating material which generates a heat by an energization is provided on a substrate;

a film which is moved in slide contact with said heater;

a pressurizing roller to form a nip together with said heater through said film;

a recording material bearing an unfixed image and sandwiched to be conveyed by said nip, the unfixed image being heated and fixed onto the recording material by a heat from said heater through said film; and power supplying means for supplying an electric power to said heater in a first mode with a first maximum power in accordance with the start of an energization and, subsequently, for supplying an electric power to said heater in a second mode with a second maximum power, wherein said first maximum power is smaller than said second maximum power, and temperature detecting means for detecting a temperature of said heater, wherein when said temperature detecting means detects a predetermined temperature, an operating mode is changed from said first mode to said second mode.

28. A fixing device according to claim 27, wherein said substrate is made of ceramic.

29. A fixing device comprising:

a heater in which a heat generating material which generates a heat by an energization is provided on a substrate;

a film which is moved in slide contact with said heater;

a pressurizing roller to form a nip together with said heater through said film;

a recording material bearing an unfixed image and sandwiched to be conveyed by said nip, the unfixed image being heated and fixed onto the recording material by a heat from said heater through said film; and power supplying means for supplying an electric power to said heater in a first mode with a first maximum power in accordance with the start of an energization and, subsequently, for supplying an electric power to said heater in a second mode with a second maximum power, wherein said first maximum power is smaller than said second maximum power, and temperature detecting means for detecting a temperature when a signal serving as a reference of the start of an energization is inputted, wherein the detection temperature by said temperature detecting means is lower than a predetermined temperature, a power control to change an operating mode from said first mode to said second mode is executed.

30. A device according to claim 29, wherein said temperature detecting means detects the temperature of said heater.

31. A fixing device according to claim 29, wherein said substrate is made of ceramic.

32. A fixing device comprising:

a heater in which a heat generating material which generates a heat by an energization is provided on a substrate;

a film which is moved in slide contact with said heater;

a pressurizing roller to form a nip together with said heater through said film;

a recording material bearing an unfixed image and sandwiched to be conveyed by said nip, the unfixed image being heated and fixed onto the recording material by a heat from said heater through said film; and power supplying means for supplying an electric power to said heater in a first mode with a first maximum power in accordance with the start of an energization and, subsequently, for supplying an electric power to said heater in a second mode with a second maximum power, wherein said first maximum power is smaller than said second maximum power, and temperature detecting means for detecting a temperature when a signal serving as a reference of the start of an energization is inputted, wherein an operating time for said first mode when the detection temperature by said temperature detecting means is lower than a predetermined temperature is longer than an operating time for said first mode when said detection temperature is higher than said predetermined temperature.

33. A device according to claim 32, wherein said temperature detecting means detects an environment temperature.

34. A fixing device according to claim 32, wherein said substrate is made of ceramic.

35. A fixing device comprising:

a heater in which a heat generating material which generates a heat by an energization is provided on a substrate;

a film which is moved in slide contact with said heater;

a pressurizing roller to form a nip together with said heater through said film;

a recording material bearing an unfixed image and sandwiched to be conveyed by said nip, the unfixed image being heated and fixed onto the recording material by a heat from said heater through said film; and power supplying means for supplying an electric power to said heater in a first mode with a first maximum power in accordance with the start of an energization and, subsequently, for supplying an electric power to said heater in a second mode with a second maximum power, wherein said first maximum power is smaller than said second maximum power, and wherein an operating time for said first mode when an interval from end of the previous energization to said heater to an input of a signal serving as a reference of the start of the present energization to said heater is longer than a predetermined time is longer than an operating time for said first mode when said interval is shorter than said predetermined time.

36. A fixing device according to claim 35, wherein said substrate is made of ceramic.

* * * * *

UNITED STATES PATENT AND TRADEMARK OFFICE

CERTIFICATE OF CORRECTION

PATENT NO. : 6,035,155

DATED : March 7, 2000

INVENTOR(S): KEIGO KAJI, ET AL.

It is certified that error appears in the above-identified patent and that said Letters Patent is hereby corrected as shown below:

COLUMN 4:
Line 7, "and be" should read --and--.

COLUMN 6:
Line 25, "be also" should read --also be--; and
Line 47, "be now" should read --now be--.

COLUMN 7:
Line 51, "be also" should read --also be--.

COLUMN 8:
Line 1, "for total" should read --for a total of--;
Line 6, "is" (2nd occurrence) should read --is ordinarily--;
Line 7, "ordinary" should be deleted;
Line 26, "for total" should read --for a total of--; and

UNITED STATES PATENT AND TRADEMARK OFFICE

CERTIFICATE OF CORRECTION

PATENT NO. : 6,035,155

DATED : March 7, 2000

INVENTOR(S): KEIGO KAJI, ET AL.

It is certified that error appears in the above-identified patent and that said Letters Patent is hereby corrected as shown below:

COLUMN 8 (Cont.):

Line 32, "is performed for ordinary" should read --is ordinarily performed for--.

Signed and Sealed this

Tenth Day of April, 2001

*Attest:*

Nicholas P. Godici

NICHOLAS P. GODICI

*Attesting Officer*

*Acting Director of the United States Patent and Trademark Office*